US010294060B2

(12) United States Patent
Hashimoto

(10) Patent No.: US 10,294,060 B2
(45) Date of Patent: May 21, 2019

(54) SHEET DISCHARGE APPARATUS AND IMAGE FORMING APPARATUS

(71) Applicant: CANON KABUSHIKI KAISHA, Tokyo (JP)

(72) Inventor: Yoshinori Hashimoto, Sagamihara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/881,007

(22) Filed: Jan. 26, 2018

(65) Prior Publication Data

US 2018/0148293 A1 May 31, 2018

Related U.S. Application Data

(63) Continuation of application No. 14/952,093, filed on Nov. 25, 2015, now abandoned.

(30) Foreign Application Priority Data

Nov. 27, 2014 (JP) ..... 2014-239412

(51) Int. Cl.
*B65H 31/20* (2006.01)
*G03G 15/00* (2006.01)
(Continued)

(52) U.S. Cl.
CPC ..... *B65H 31/20* (2013.01); *B65H 31/02* (2013.01); *B65H 31/24* (2013.01);
(Continued)

(58) Field of Classification Search
CPC ..... B65H 31/20; B65H 31/24; B65H 31/26; B65H 2405/332; B65H 2801/06; B65H 2405/1124
See application file for complete search history.

(56) References Cited

U.S. PATENT DOCUMENTS 7,547,015 B2 6/2009 Lee et al.
7,762,546 B2 7/2010 Wakakusa et al.
(Continued)

FOREIGN PATENT DOCUMENTS

JP 9-194107 A 7/1997
JP 2004-075283 A 3/2004
(Continued)

OTHER PUBLICATIONS

Machine translation of JP2013-40031, 2013.*
Japanese Office Action dated Jul. 31, 2018, in related Japanese Patent Application No. 2014-239412.

*Primary Examiner* — Thomas A Morrison
(74) *Attorney, Agent, or Firm* — Venable LLP

(57) ABSTRACT

A discharge extension tray can be extended in a sheet discharge direction from a discharge tray. A front end regulating portion is coupled to the discharge extension tray on a downstream side in the sheet discharge direction of the discharge extension tray such that the front and regulating portion is turnable with respect to the discharge extension tray. A sheet guide portion guides a front end portion of the sheet to a direction separating from a turning center of the front end regulating portion when a sheet having a length longer than a predetermined size is discharged in a state where the discharge extension tray is not extended from the discharge tray.

6 Claims, 8 Drawing Sheets

(51) Int. Cl.
*B65H 31/02* (2006.01)
*B65H 31/24* (2006.01)

(52) U.S. Cl.
CPC . *G03G 15/6552* (2013.01); *B65H 2301/4212* (2013.01); *B65H 2405/1111* (2013.01); *B65H 2405/1124* (2013.01); *B65H 2405/11151* (2013.01); *B65H 2405/11164* (2013.01); *B65H 2405/12* (2013.01); *B65H 2405/332* (2013.01); *B65H 2408/111* (2013.01); *B65H 2511/11* (2013.01); *B65H 2511/20* (2013.01)

(56) References Cited

U.S. PATENT DOCUMENTS

| | | | | |
|---|---|---|---|---|
| 7,850,168 | B2 | 12/2010 | Shinkawa et al. | |
| 8,424,871 | B2 | 4/2013 | Ino | |
| 8,814,158 | B2 * | 8/2014 | Washino ..... | B65H 31/26 271/171 |
| 2012/0061902 | A1 | 3/2012 | Ino | |
| 2014/0103603 | A1 | 4/2014 | Horita et al. | |
| 2014/0167349 | A1 | 6/2014 | Niimura | |

FOREIGN PATENT DOCUMENTS

| | | | |
|---|---|---|---|
| JP | 2005-091562 | A | 4/2005 |
| JP | 2006-117328 | * | 5/2006 |
| JP | 2007-086599 | A | 4/2007 |
| JP | 2009-083992 | A | 4/2009 |
| JP | 2012-062133 | A | 3/2012 |
| JP | 2013-40031 | * | 2/2013 |
| JP | 2013-056722 | A | 3/2013 |
| JP | 2014-015325 | A | 1/2014 |
| JP | 2014-076896 | A | 5/2014 |

* cited by examiner

SHEET DISCHARGE APPARATUS AND IMAGE FORMING APPARATUS

This application is a continuation of application Ser. No. 14/952,093, filed Nov. 25, 2015.

BACKGROUND OF THE INVENTION

Field of the Invention

The present invention relates to a sheet discharge apparatus, and an image forming apparatus such as a printer, a copying machine, a facsimile including the same.

Description of the Related Art

Some image forming apparatuses are equipped with a sheet discharge apparatus including a plurality of discharge trays in addition to a fired discharge tray as the sheet discharge apparatus on which sheets having images formed thereon are discharged and stacked to be received by a user.

Such sheet discharge apparatus may be equipped with a discharge extension tray capable of having the stacking area expanded in correspondence with a long-sized sheet, in addition to the discharge tray on which discharged sheets are stacked. For example, Japanese Patent Application Laid-open Publication No. 2007-86599 discloses a configuration where an installation angle of a discharge extension tray is changed in response to the sheet type. By adopting such configuration, it becomes possible to perform stable discharging and stacking of sheets, regardless of the size and hardness of the sheets.

SUMMARY OF THE INVENTION

According to a first aspect of the present invention, a sheet discharge apparatus includes a discharge tray on which a discharged sheet is stacked, a discharge extension tray capable of being extended in a sheet discharge direction from the discharge tray, a front end regulating portion coupled to the discharge extension tray on a downstream side, in the sheet discharge direction, of the discharge extension tray in such a manner that the front end regulating portion is turnable with respect to the discharge extension tray, and a sheet guide portion guiding a front end portion of the sheet to a direction separating from a turning center of the front end regulating portion when a sheet having a length longer than a predetermined size is discharged in a state where the discharge extension tray is not extended from the discharge tray.

According to a second aspect of the present invention, a sheet discharge apparatus includes a discharge portion configured to discharge a sheet in a discharge direction, a first stacking portion on which the sheet discharged by the discharge portion is stacked, and a second stacking portion capable of extending a stacking surface on which the sheet discharged by the discharge portion is stacked by being drawn out with respect to the first stacking portion. The second stacking portion includes a front end regulating portion capable of turning around a turning center and regulating a position of a front end of the sheet in the discharge direction, and a sheet guide portion disposed at least partially upstream, in the discharge direction, of the turning center and capable of guiding the front end of the sheet to a direction separating from the turning center.

According to a third aspect of the present invention, a sheet discharge apparatus includes a stacking portion on which a discharged sheet is stacked, a front end regulating portion regulating a front end position of the sheet discharged on the stacking portion, and a sheet guide portion guiding the front end of the sheet upward in a downstream direction of a sheet discharge direction at an upstream side in the sheet discharge direction of the front end regulating portion.

Further features of the present invention will become apparent from the following description of exemplary embodiments with reference to the attached drawings.

DESCRIPTION Of THE EMBODIMENTS

First Embodiment

Now, a configuration of an image forming apparatus 100 equipped with a sheet discharge apparatus 200 according to a first embodiment will be described with reference to FIGS. 1 through 3B.

Image Forming Apparatus

Figure 1:
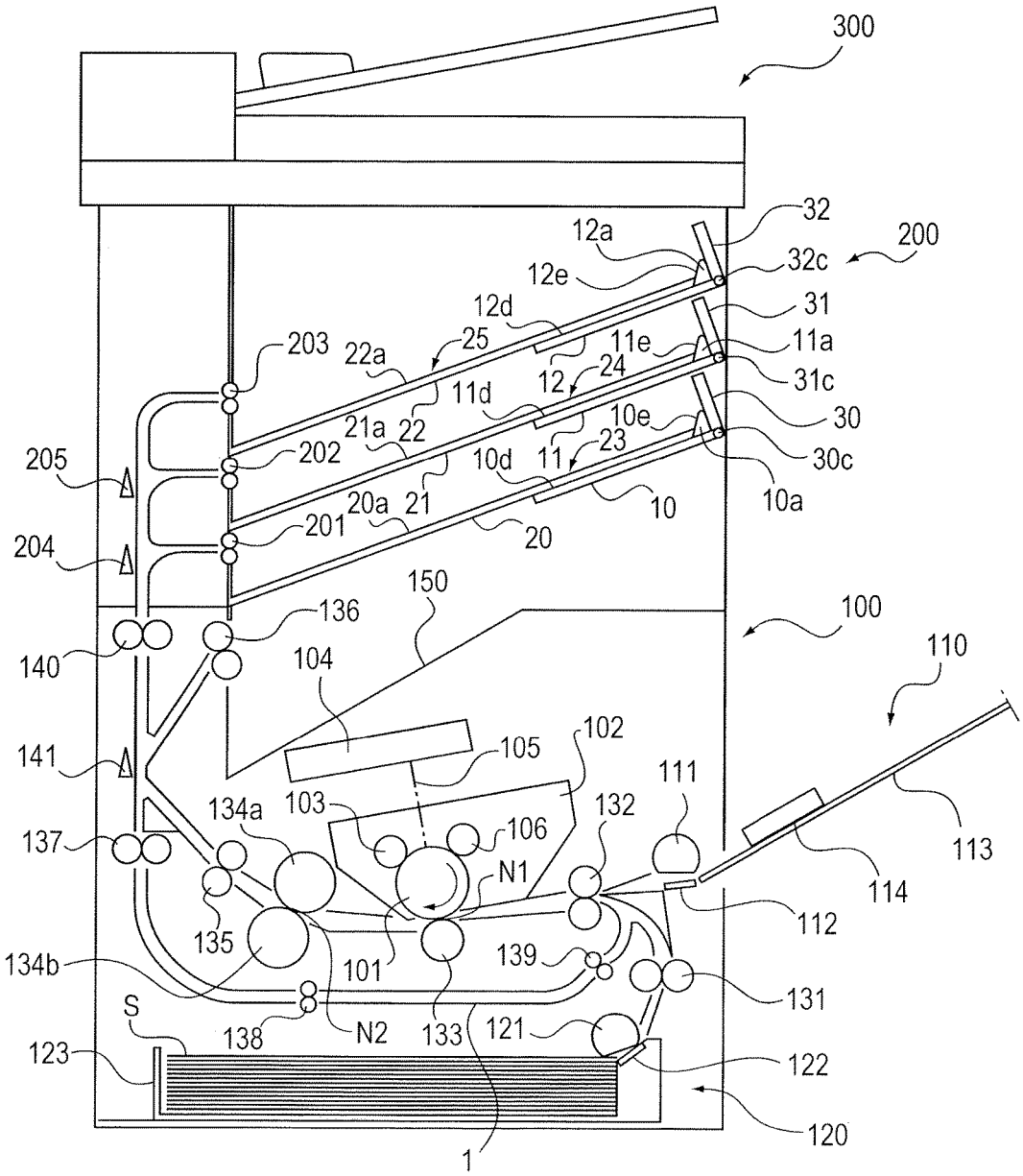
FIG. 1 is a schematic cross-sectional view of an image forming apparatus according to a first embodiment.

At first, we will describe an image forming operation and a sheet conveying operation in the image forming apparatus 100 with reference to FIG. 1. In FIG. 1, a photosensitive drum 101 as an image bearing member has both longitudinal ends thereof supported rotatably with respect to a process cartridge 102 as an image forming portion containing a black developer (toner) for example.

A rotational driving force is transmitted from a drive motor and a drive transmission mechanism not shown to the photosensitive drum 101 from one end side in the longitudinal direction, and the photosensitive drum 101 is driven to rotate in a clockwise direction of FIG. 1. An electrophotoconductor layer is applied on a surface of the photosensitive drum 101. By applying electrification bias voltage to a charging roller 103 as a charging unit, the surface of the photosensitive drum 101 is charged evenly.

A laser team 105 corresponding to image information is irradiated from a laser scanner unit 104 as an image exposure unit to a surface of the photosensitive drum 101 evenly charged by the charging roller 103, and an electrostatic latent image is formed on the drum 101. A developer is supplied to the electrostatic latent image formed on the surface of the photosensitive drum 101 from a developing roller 106 of a developing unit, and the electrostatic latent image is developed as a toner image. Image information can include information obtained by reading an image of a document via a document reading apparatus 300 disposed at an upper portion of the image forming apparatus 100, and mage information transmitted from an external terminal such as a personal computer connected to the image forming apparatus 100.

A first feeding portion 110 is composed, for example, of a feeding roller 111, a separating pad 112, a sheet tray 113, a sheet width regulating plate 114 and so on. Sheets S are stacked on the sheet tray 113. Sheets S are fed by the feeding roller 111 driven at given timings by a drive motor and a drive transmission mechanism not shown.

When there are multiple sheets S stacked on the sheet tray 113, the sheets are sorted by the friction force of the separating pad 112, and only a single sheet S is fed to the registration roller 132 at a time. Thereafter, the sheet S is carried via a registration roller 132 to a transfer nip portion N1 where the photosensitive drum 101 and a transfer roller 133 as a transfer portion contact one another. In the transfer nip portion N1, a toner image (image) formed on the surface of the photosensitive drum 101 is transferred onto the sheet S by the transfer roller 133 to which a given transfer bias voltage is applied.

The sheet S to which the toner image has been transferred is carried to a fixing nip portion N2 where a fixing roller 134*a* and a pressure roller 134*b* of a fixing unit contact one another. In the fixing nip portion N2, the toner image is fixed to the surface of the sheet S via melt-fixing by applying heat and pressure.

The sheet having been nipped and conveyed by the fixing roller 134*a* and the pressure roller 134*b* is nipped and conveyed by a discharge roller 135. Thereafter, the sheet is conveyed via a switching member 141 to a discharge roller 136, nipped and conveyed by the discharge roller 136, and then discharged and stacked on a discharge 150.

A second feeding portion 120 is provided at a lower portion of the image forming apparatus 100 shown in FIG. 1. The second feeding portion 120 is composed of a feeding roller 121, a separating pad 122, a sheet feed cassette 123 and so on. In the sheet feed cassette 123, sheets S are stacked on a positioning plate not shown capable of moving up and down.

Sheets S are fed by the feeding roller 121 driven at given timings by the drive motor and the drive transmission mechanism not shown. At the same time, the sheets S are sorted by the friction force of the separating pad 122, and only a single sheet S is fed to a conveyance roller 131 at a time. Thereafter, the sheet S is nipped and conveyed via the conveyance roller 131, and conveyed to a registration roller 132.

Thereafter, the sheet S is conveyed via the registration roller 132 to the transfer nip portion N1 where the photosensitive drum 101 and the transfer roller 133 contact one another. Then, the sheet S is conveyed similarly as the sheet fed from the first feeding portion 110, and discharged onto a discharge tray 150 or the sheet discharge apparatus 200 and stacked thereon.

When printing images on both sides of the sheet S, at a timing when a rear end portion of the sheet S nipped and conveyed by the discharge roller 136 passes the switching member 141, the discharge roller 136 is rotated in the opposite direction, and the sheet S is conveyed to an inversion path 1. Then, the sheet S is nipped and conveyed by conveyance rollers 137 through 139, and conveyed again to the registration roller 132. The operation that follows is similar to the operation performed in the aforementioned simplex printing.

Sheet Discharge Apparatus

Next, a sheet discharge operation in the sheet discharge apparatus 200 disposed at an upper portion of the image forming apparatus 100 will be described with reference to FIGS. 1 through 3. The sheet discharge apparatus 200 is equipped with a plurality of discharge extension trays 10 through 12 of multiple stages, a plurality of discharge trays 20 through 22 disposed in multiple stages, a plurality of front end regulating portions 30 through 32 of multiple stages for regulating the front ends of sheets S, and so on. The discharge trays 20 through 22 and the discharge extension trays 10 through 12 constitute a stacking portion 23 on which the discharged sheets are stacked. When conveying a sheet S to the sheet discharge apparatus 200 illustrated in FIG. 1, the toner image formed on the surface of the photosensitive dram 101 is transferred to the sheet S at the transfer nip portion N1, as described earlier. Then, after the toner image is fixed to the sheet S at the fixing nip portion N2, the sheet S is conveyed to the conveyance roller 140 via the switching member 141.

The conveyance path of the sheets S carried and conveyed by the conveyance roller 140 is switched appropriately via switching members 204 and 205. Thereafter, the sheets S are nipped and conveyed by one of discharge roller pairs (discharge portions) 201 through 203 as discharge rotators, and selectively discharged and stacked on one of the discharge trays (first stacking portions) 20 through 22 for stacking sheets S.

Now, in the sheet discharge apparatus 200, the user can selectively switch the discharge tray on which the sheet is discharged by the operation of the user. The operation of the user includes output of signals from a personal computer (PC), operation of buttons on a control panel, authentication of ID (identification), and so on.

By selecting the discharge tray in response to each user, or in accordance with the sheet type and so on, the user can easily receive his/her job without having the sheets mixed with jobs of other users.

The sheet discharge apparatus 200 is equipped in advance with a discharge tray 150 having a large stacking area so as to correspond to long-sized sheets. However, in consideration of the size of the image forming apparatus 100 body and the facilitation of the removal of the sheets from the discharge tray 150, a configuration is adopted where the discharge extension trays 10 through 12 are drawn out and extended from the discharge trays 20 through 22 in order to save space.

Figure 3A:
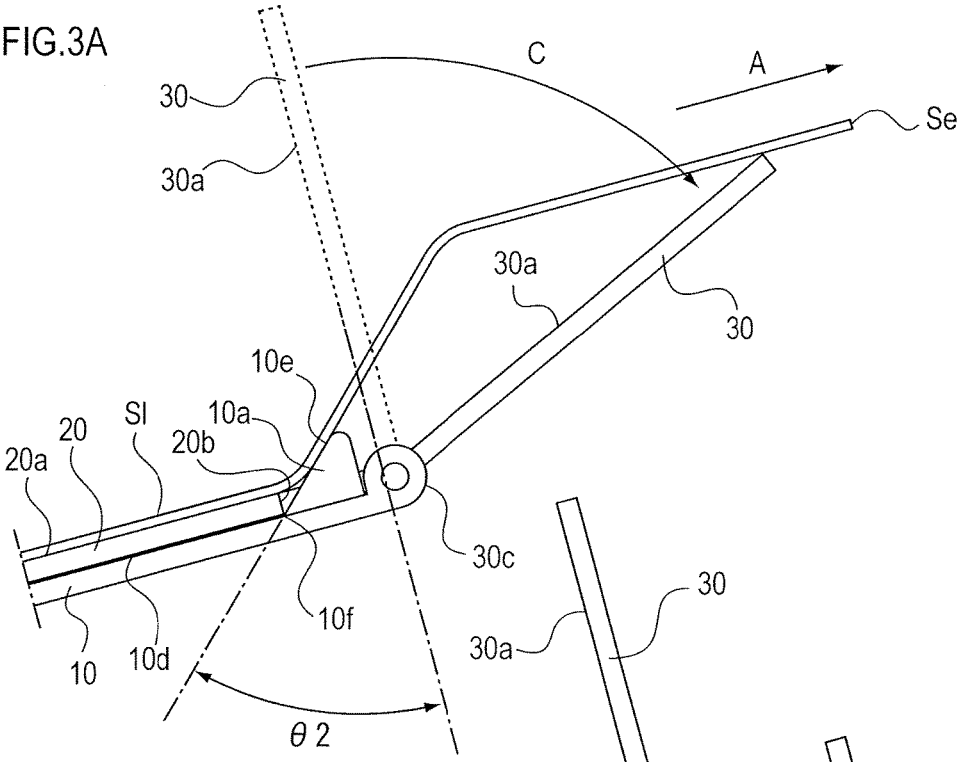
FIG. 3A is a cross-sectional view of the sheet discharge apparatus according to the first embodiment, illustrating a long-sized sheet discharged in a state where a discharge extension tray is not drawn out.
Figure 3B:
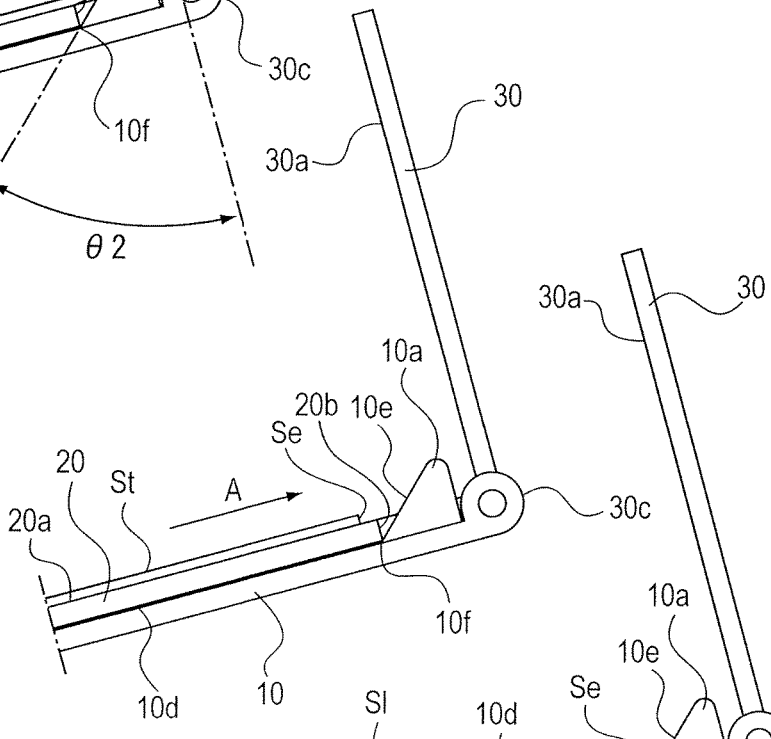
FIG. 3B is a cross-sectional view of the sheet discharge apparatus according to the first embodiment, illustrating an A4-sized sheet discharged in a state where the discharge extension tray is not drawn out.
Figure 3C:
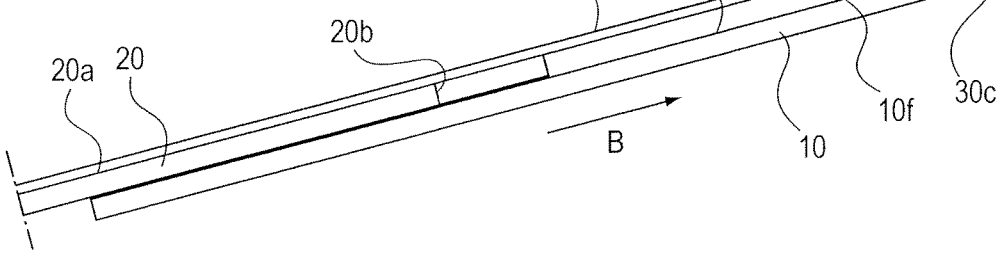
FIG. 3C is a cross-sectional view of the sheet discharge apparatus according to the first embodiment, illustrating a long-sized sheet discharged in a state where the discharge extension tray is drawn out.

The respective discharge trays 20 through 22 have discharge extension trays (second stacking portions) 10 through 12 capable of being extended in a sheet discharge direction (direction of arrow A) with respect to the respective discharge trays 20 through 22 supported movably (slidably) to be drawn out in a direction of arrow B of FIG. 3C. Therefore, the user can draw out the respective discharge extension trays 10 through 12 in the direction of arrow B of FIG. 3C in response to the size of the sheet S being used.

Front end regulating portions 30 through 32 turnable in a direction of arrow C of FIG. 3A around respective turning shafts 30*c* through 32*c* are respectively connected to a front end portion (downstream side in a sheet discharge direction) of the respective discharge extension trays 10 through 12. The respective front end regulating portions 30 through 32 are disposed turnable between a first position and a second position turned downstream in the sheet discharge direction from the first position (respectively having a large angle with the discharge extension trays 10 through 12), turning around turning shafts 30*c* through 32*c* (adjacent to a coupling portion) which are the coupling portions with the respective discharge extension trays 10 through 12.

Torsion coil springs 33 as biasing members are respectively fit to turning shafts 30*c* through 32*c* of the respective front end regulating portions 30 through 32 to bias the front end regulating portions toward the turning direction from the second position to the first position. The user receives the sheets S stacked on the respective discharge trays 20 through 22 and the discharge extension trays 10 through 12 by turning the turning shafts 30*c* through 32*c* of the respective front end regulating portions 30 through 32 around the respective turning shafts 30*c* through 32*c* toward the direction of arrow C of FIG. 3A (turning direction from the first position to the second position) resisting against the biasing force of the torsion coil spring 33. Since the front end regulating portions 30 through 32 can be turned to the second position, the users can easily receive the sheets respectively stacked on the discharge trays 20 through 22 and discharge extension trays 10 through 12.

Thereafter, the respective front end regulating portions 30 through 32 are turned to an opposite direction from the direction of arrow C of FIG. 3A (in a direction turning from the second position to the first position) around the respective turning shafts 30*c* through 32*c* by the biasing force of the respective torsion coil springs 33, and are returned to a home position (first position) erected substantially perpendicularly from the respective discharge extension trays 10 through 12.

Furthermore, the user draws out the discharge extension trays 10 through 12 in the direction of arrow B of FIG. 3C in correspondence with the size of the sheets S being used. Thereby, the sheets S are respectively nipped and conveyed via discharge roller pairs 201 through 203, and discharged onto the respective discharge trays 20 through 22 and discharge extension trays 10 through 12. At that time, the position of a front end portion Se of the discharged sheet S is regulated by abutting the front end portion Se against the respective front end regulating portions 30 through 32 erected substantially perpendicularly from the discharge extension trays 10 through 12. Thus, the sheets can be prevented from falling out of the discharge trays 20 through 22 and the discharge extension trays 10 through 12.

In other words, the sheets S are nipped and conveyed respectively by the discharge roller pairs 201 through 203 in the image forming apparatus 100 body, and are respectively discharged to the discharge trays 20 through 22 and the discharge extension trays 10 through 12. At this time, if there are no front end regulating portions, the discharged sheets S may be discharged downstream from a given position in the sheet discharge direction shown by arrow A.

Further, the sheets S stacked respectively on the discharge trays 20 through 22 and the discharge extension trays 10 through 12 may be pushed downstream in the sheet discharge direction by electrostatic attraction or friction with subsequently discharged sheets S.

Therefore, the positions of the front end portions Se of the sheets S discharged respectively on the discharge trays 20 through 22 and discharge extension trays 10 through 12 are respectively abutted to front end regulating portions 30 through 32 for regulation. Thus, it becomes possible to prevent sheets S discharged onto the discharge trays 20 through 22 and discharge extension trays 10 through 12 from falling out of the discharge trays 20 through 22 and the discharge extension trays 10 through 12.

As described, in addition to the discharge trays for stacking discharged sheets, the sheet discharge apparatus is equipped with discharge extension trays 10 through 12 for expanding the stacking areas to correspond to long-sized sheets, such as LGL (Legal)-sized sheets (215.9 mm×355.6 mm). As described above, Japanese Patent Application Laid-Open Publication No. 2007-86599 discloses a configuration of changing an installation angle of a discharge extension tray according to the sheet type. However, if the installation angle of the discharge extension tray is changed as in the configuration taught in the publication, it may be difficult to access the sheets on the discharge tray when receiving the sheets. Moreover, if a discharge port is widened to enable change of installation angle of the discharge extension tray, the size of the whole apparatus is increased.

Therefore, according to the present embodiment, the discharge extension trays 10 through 12 are drawn out substantially in parallel with the discharge trays 20 through 22 according to the sheet size, and front end regulating portions 30 through 32 of sheets are provided to prevent the discharged sheets from falling. However, the following problems occur by simply providing front end regulating portions 3D through 32. This drawback will be described with reference to a comparative example illustrated in FIGS. 4 through 6B. In the following comparative example, the same reference numbers are assigned in configurations similar to the present embodiment, the descriptions thereof are omitted or simplified.

Comparative Example

Figure 4:
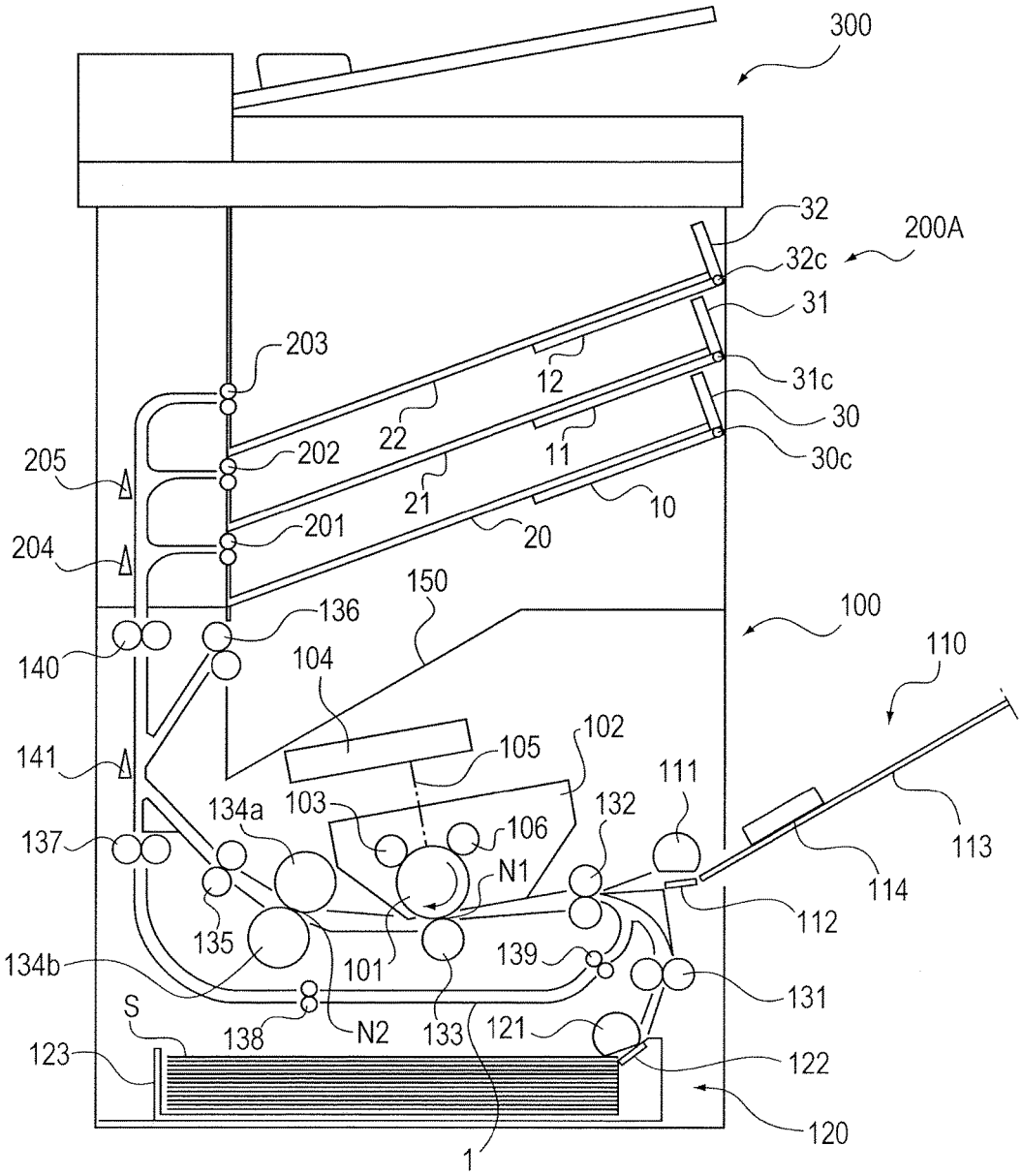
FIG. 4 is a schematic cross-sectional view of an image forming apparatus of a comparative example.

As shown in FIG. 4, the sheet S to which image has been formed in the image forming apparatus 100 is conveyed to the sheet discharge apparatus 200A disposed in an upper area via the switching member 141. Further, the sheet S is discharged on one of a plurality of discharge trays 20 through 22 switched selectively by the switching members 204 and 205.

Figure 5B:
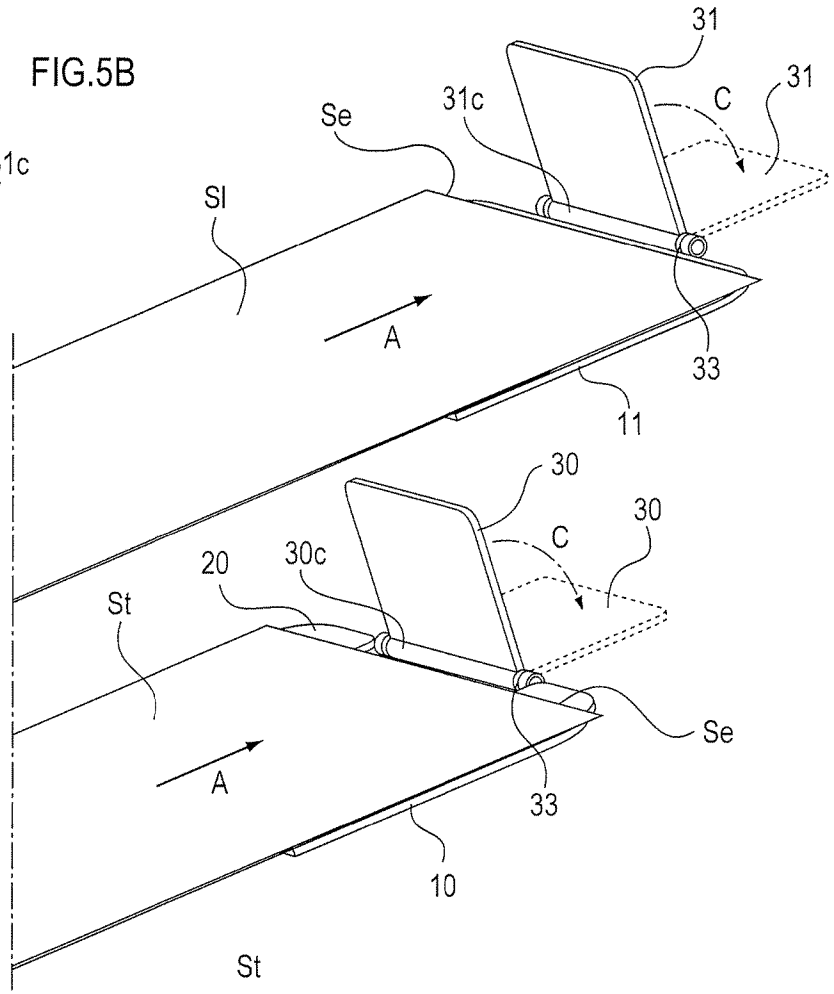
FIG. 5B is a perspective view of a sheet discharge apparatus according to the comparative example, illustrating a long-sized sheet discharged in a state where the discharge extension tray is drawn out, and an A4-sized sheet discharged in a state where the discharge extension tray is not drawn out.
Figure 5A:
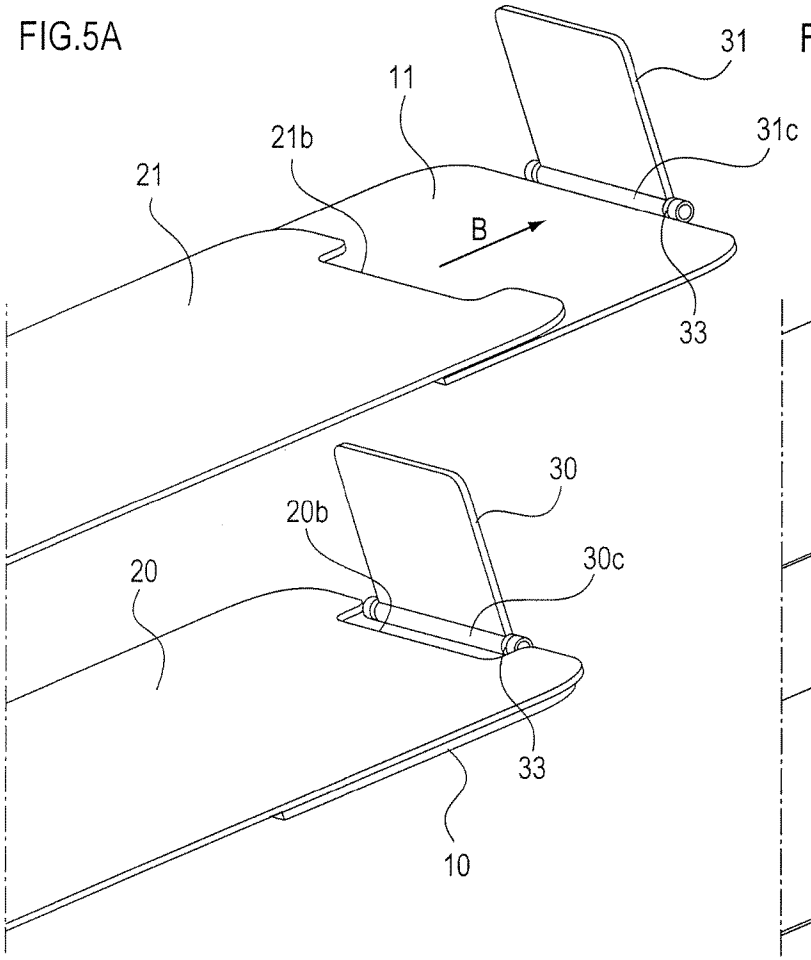
FIG. 5A is a perspective view of a configuration of a sheet discharge apparatus according to the comparative example.

FIGS. 5A and 5B show the relationship between the size of the discharged sheets the discharge extension trays 10 through 12, and the front end regulating portions 30 through 32 for the sheet S. FIGS. 5A and 5B are partial perspective diagrams showing in enlarged views the area including the lower two discharge trays 20 and 21 in the sheet discharge apparatus 200A equipped with the plurality of discharge trays 20 through 22. FIG. 5A shows a state where the sheets S are not stacked on the discharge trays 20 and 21. FIG. 5B shows a state where the sheets S are stacked on the discharge trays 20 and 21.

In FIG. 5B, a state is illustrated where predetermined sized sheets St, such as A4-sized (210 mm×297 mm) sheets, are stacked on the lowermost discharge tray 20. Further, long-sized sheets S1 having a longer length than the predetermined size, such as LGL (legal)-sized (215.9 mm×355.6 mm) sheets, are stacked on the middle discharge tray 21 and the discharge extension tray 11.

As described, a configuration is adopted to correspond to long-sized sheets S1 by enabling the discharge extension trays 10 and 11 to be extended in correspondence with the size of the sheets S used by the user.

The front end portions Se of the sheets S stacked respectively on the discharge trays 20 through 22 and discharge extension trays 10 through 12 are regulated by being abutted against the respective front end regulating portions 30 through 32 erected substantially perpendicularly from the discharge extension trays 10 through 12.

Figure 7A:
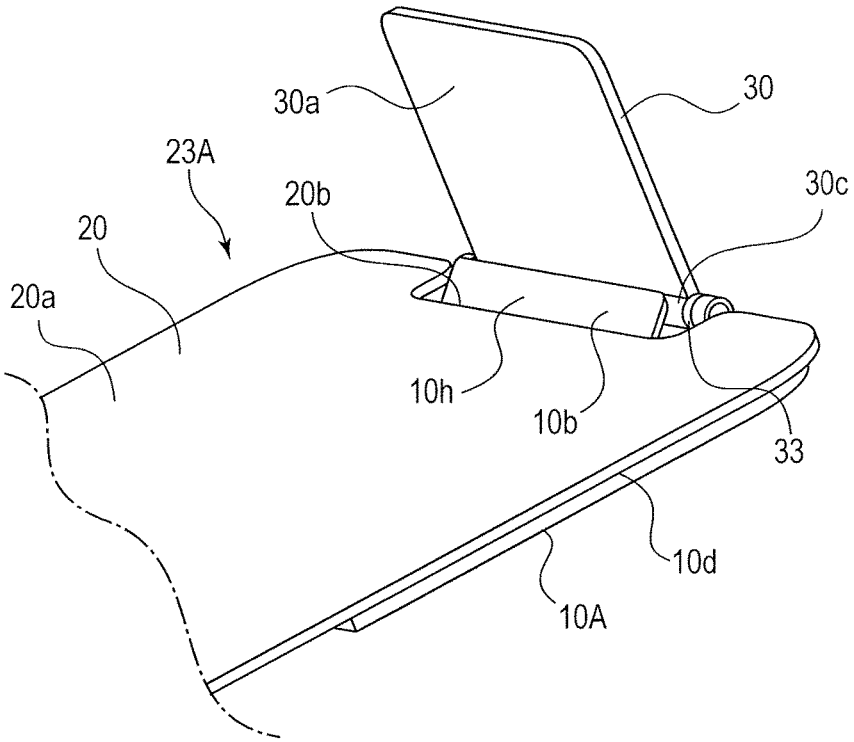
FIG. 7A is a perspectives view illustrating a configuration of a sheet discharge apparatus according to a second embodiment.
Figure 7B:
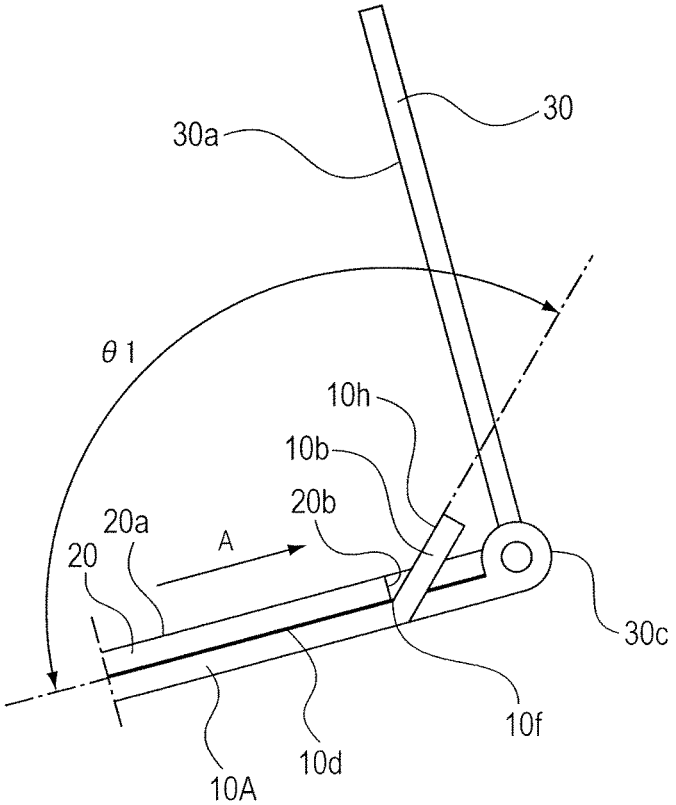
FIG. 7B is a cross-sectional view illustrating a configuration of the sheet discharge apparatus according to the second embodiment.

The front end regulating portions 30 and 31 illustrated in FIGS. 7A and 7B are connected turnably with the discharge extension trays 10 and 11 via turning shafts 30*c* and 31*c*. The user draws out and extends the discharge extension tray 10 or 11 from the discharge tray 20 or 21 corresponding to the sheet S being used. Then, the front end regulating portion 30 or 31 is turned around the turning shaft 30*c* or 31*c* and erected. Thereby, the position of the front end portion Se of the sheet S can be regulated by the front end regulating portion 30 or 31 corresponding to the sheet S.

Further, the front end regulating portions 30 and 31 can turn around the respective turning shafts 30*c* and 31*c* in the direction of arrow C of FIG. 5B. The user receives the sheets S respectively stacked on the discharge trays 20 and 21 and the discharge extension trays 10 and 11. At that time, the respective front end regulating portions 30 and 31 are turned around the respective turning shafts 30*c* and 31*c* in the direction of arrow C of FIG. 5B opposing to the biasing force of the torsion coil spring 33, by which the front end regulating portions 30 and 31 are pushed down on an extended line of the discharge extension trays 10 and 11 to the outer side of the sheet discharge apparatus 200.

Thus, a configuration is adopted where sheets S stacked on the respective discharge trays 20 and 21 and discharge extension trays 10 and 11 can easily be accessed. The uppermost discharge tray 22, the discharge extension tray 12 and the front end regulating portion 32 of the sheet discharge apparatus 200A illustrated in FIG. 4 are also similarly configured. In the above description, the user draws out the discharge extension trays 10 through 12 corresponding to the size of the sheet S being used, but we will now consider a case where a long-sized sheet S1 of LGL size or the like is discharged on the discharge tray 20 without the user drawing out the discharge extension tray 10, as shown in FIGS. 6A and 6B.

Figure 6A:
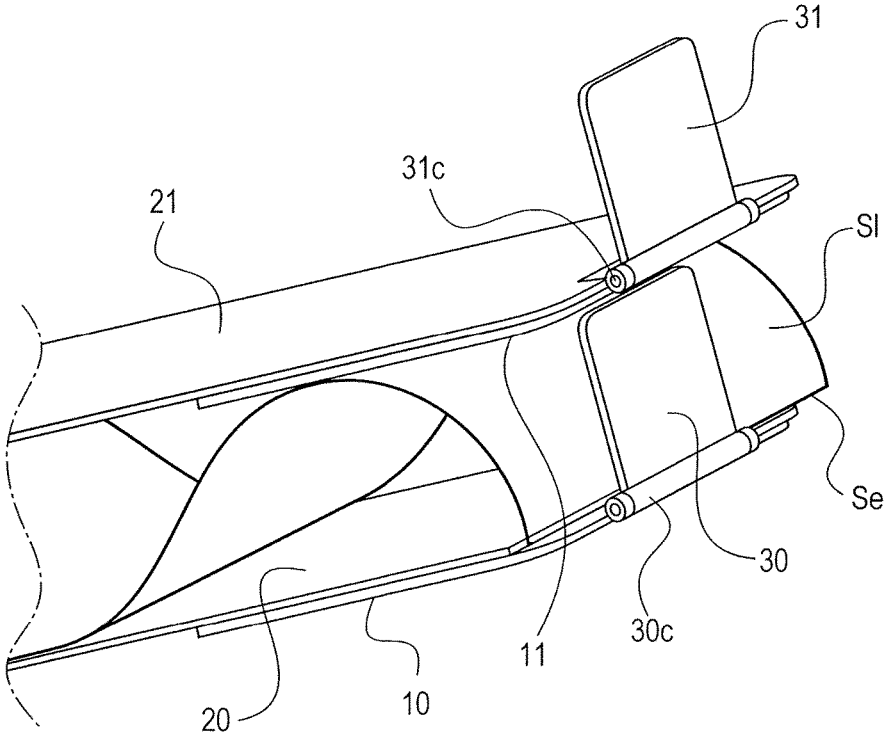
FIG. 6A is a perspective view of the sheet discharge apparatus according to the comparative example, illustrating a long-sized sheet discharged in a state where the discharge extension tray is not drawn out.
Figure 6B:
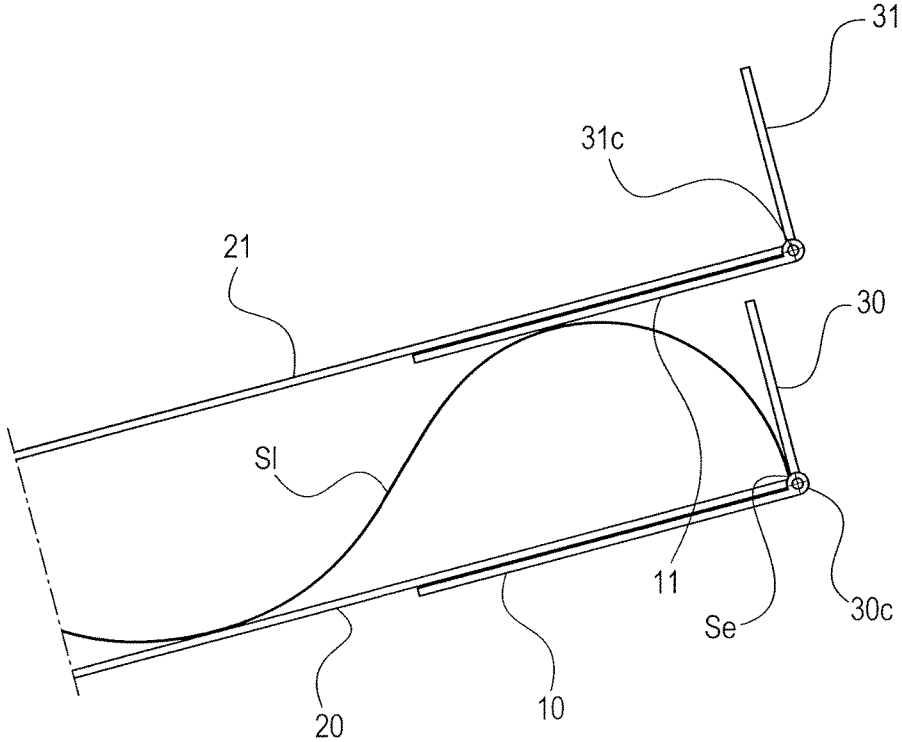
FIG. 6B is a cross-sectional view of the sheet discharge apparatus according to the comparative example, illustrating a long-sized sheet discharged in a state where the discharge extension tray is not drawn out.

In such case, as shown in FIGS. 6A and 6B, the front end portion S3 of the sheet S may be caught at a base portion near the turning shaft 30*c* of the front end regulating portion 30 erected substantially perpendicularly iron the discharge extension tray 10, by which the sheet S1 may be jammed or curled, or even damaged.

Therefore, there is a demand for a sheet discharge apparatus 200 where jamming and curling of the sheet S1 or damaging of the sheet S1 will, not occur even when the long-sized sheet S1 of LGL size or the like is discharged without the user drawing out the discharge extension tray 10. The same applies for the middle and uppermost discharge trays 21 and 22, discharge extension trays 11 and 12 and front end regulating portions 31 and 32 of the sheet discharge apparatus 200A illustrated in FIG. 4.

Therefore, the present embodiment provides a sheet discharge apparatus capable of preventing jamming and curling of the sheet or damaging of the sheet, regardless of the set position of the discharge extension tray or the else of the sheet being discharged.

Sheet Discharge Apparatus According to Present Embodiment

Figure 2A:
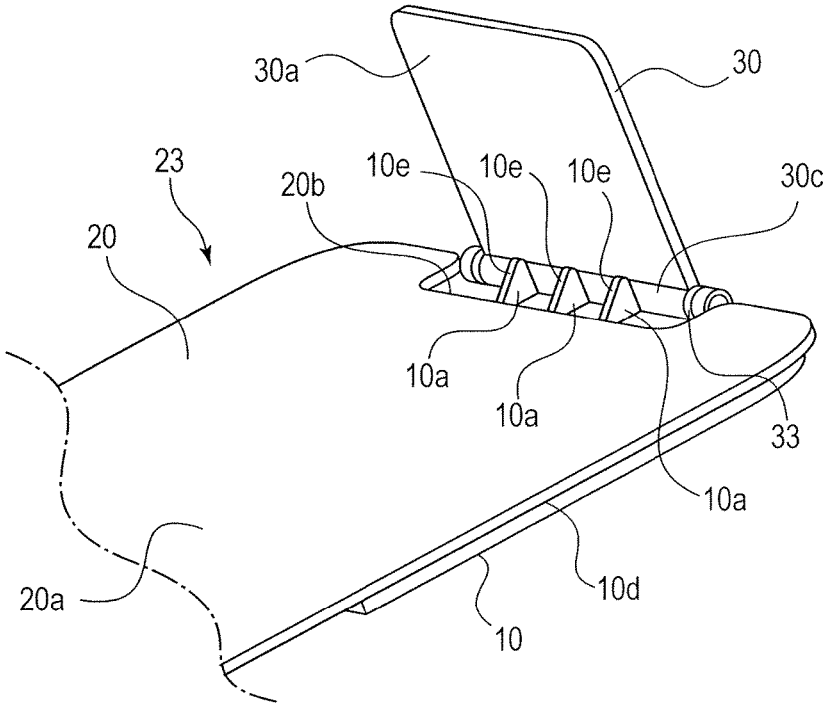
FIG. 2A is a perspective view illustrating a configuration of a sheet discharge apparatus according to the first embodiment.

According to the present embodiment, as illustrated in FIG. 2A, a cutout portion 20*b* dented from a front end portion of each discharge tray 20 through 22 toward the upstream side in the sheet discharge direction is formed at a downstream end (front end) in the sheet discharge direction of the respective discharge trays 20 through 22. Three substantially triangular ribs 10*a* through 12*a* (projections) are provided in protruded manner to the respective discharge extension trays 10 through 12 near the respective turning shafts (turning center) of the respective front end regulating portions 30 through 32 disposed turnably on the discharge extension trays 10 through 12. In other words, the ribs 10*a* through 12*a* are formed to protrude upward from a portion of the discharge extension trays 10 through 12. The ribs 10*a* through 12*a* are disposed in parallel along the direction of the respective turning shafts 30*c* through 32*c*. At least a portion (all, in the illustrated example) of the ribs 10*a* through 12*a* are disposed on the upstream side in the discharge direction from the turning center of the turning shafts 30*c* through 32*c*, and enter the cutout portion 20*b*.

The ribs 10*a* through 12*a* as sheet guiding portions respectively have inclined surfaces 10*e* through 12*e* inclined upward in a downstream direction of the sheet discharge direction. Therefore, the respective inclined surfaces 10*e* through 12*e* have greater inclination to the horizontal direction than the sheet discharge direction of the respective discharge extension trays 10 through 12. Furthermore, the ribs 10*a* through 12*a* are protruded upward in a vertical direction than the turning shafts 30*c* through 32*c* and the discharge extension tray 10.

As shown in FIG. 2A, the three respective ribs 10*a* through 12*a* are exposed through the cutout portions 20*b* of the respective discharge trays 20 through 22 in a state where the respective discharge extension trays 10 through 12 are completely stored below the discharge trays 20 through 22 (in a state where the respective discharge extension trays 10 through 12 are not extended (drawn out) from the discharge trays 20 through 22).

As described as shown in FIGS. 1 through 3B, a plurality of ribs 10*a* through 12*a* having inclined surfaces 10*e* through 12*e* as sheet guide portions are provided to the respective discharge extension trays 10 through 12 on the downstream side in the sheet discharge direction. The inclined surfaces 10*e* through 12*e* are inclined upward the downstream direction of the sheet discharge direction with respect to sheet guide surfaces 10*d* through 12*d* of the discharge extension trays 10 through 12.

Figure 2B:
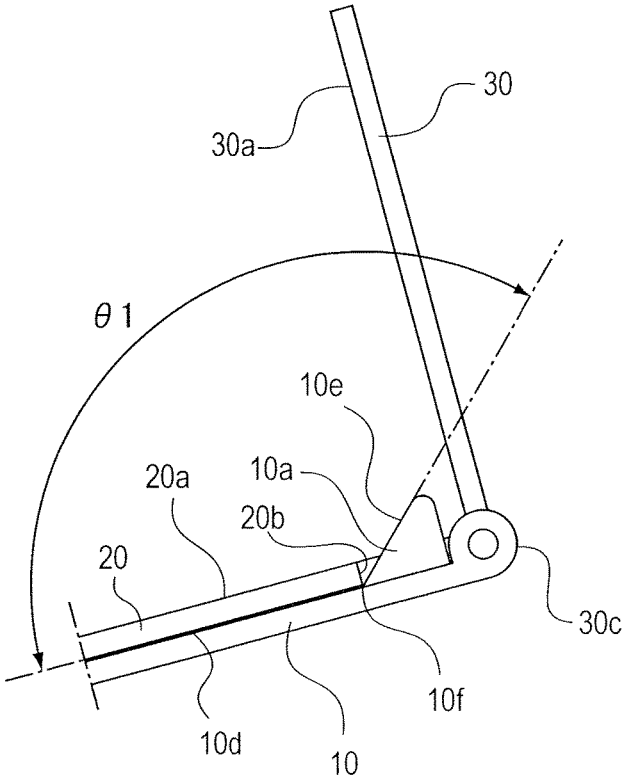
FIG. 2B is a cross-sectional view illustrating a configuration of the sheet discharge apparatus according to the first embodiment.

As shown in FIG. 2B, sheet guide surfaces 20*a* through 22*a* of the respective discharge trays 20 through 22 or the sheet guide surfaces 10*d* through 12*d* of the respective discharge extension trays 10 through 12 and the inclined surfaces 10*e* through 12*e* of the respective ribs 10*a* through 12*a* are connected successively with an angle θ1 being an obtuse angle (angle greater than 90 degrees).

Sheets S are nipped and conveyed via respective discharge rollers 201 through 203 illustrated in FIG. 1, and discharged on the respective discharge trays 20 through 22 and discharge extension trays 10 through 12. The front end portions Se of the discharged sheets S are guided smoothly from the sheet guide surfaces 20*a* through 22*a* of the respective discharge trays 20 through 22 or the sheet guide surfaces 10*d* through 12*d* of the respective discharge extension trays 10 through 12 to the inclined surfaces 10*e* through 12*e* of the respective ribs 10*a* through 12*a*.

As shown in FIG. 3A, a sheet S1 having a length longer in the sheet discharge direction (longer than a predetermined size) than the drawn out position of the discharge extension tray 10 (which is not drawn out in the illustrated example) is nipped and conveyed by the discharge roller pair 201 and discharged on the discharge tray 20 and the discharge extension tray 10. In that case, the sheet is discharged so that the front end portion Se of the sheet S1 is lifted upward in FIG. 3A along the inclined surface 10*e* of the rib 10*a* before it contacts the front end regulating portion 30 erected substantially perpendicularly from the discharge extension tray 10.

The draw out position of the discharge extension tray 10 illustrated in FIG. 3A is set to a position corresponding to 297 mm, which is the longitudinal length of sheet St having a predetermined size of A4 size (210 mm×297 mm).

Then, when a sheet S1 having a length longer than A4 size as predetermined size is discharged, the front end portion Se of the sheet S1 is guided by the inclined surface 10*e* as sheet guide portion to a direction separating from the turning shaft 30*c* as turning center of the front end regulating portion 30.

In the sheet discharge direction shown by arrow A direction of FIG. 3B, a base point 10*f* of change of angle (change of angle in which the sheet guide portion is formed) between the sheet guide surface 10*d* of the discharge extension tray 10 and the inclined surface 10*e* of the rib 10*a* is set as follows. That is, the sheet St of A4 size illustrated in FIG. 3B is set to be positioned on the downstream side in the sheet discharge direction (right side of FIG. 3B) than the front end portion Se of the sheet St when discharged and stacked on the discharge tray 20. FIG. 3B shows a state where the discharge extension tray 10 is not drawn out from the discharge tray 20. Therefore in a state where the discharge extension tray 10 is not extended, the rib 10*a* is positioned at a downstream side in the sheet discharge direction than the front end portion S3 of the sheet St having a predetermined size discharged onto the discharge tray 20.

Therefore, we will consider a case where a long-sized sheet S1 of LGL size and the like that is longer than the predetermined size is discharged on the discharge extension tray 10 without drawing out the discharge extension tray 10, as shown in FIG. 3A. When discharged in the sheet discharge direction shown by the direction of arrow A of FIG. 3A, the sheet S1 is discharged so that the front end portion Se of the sheet S1 is lifted in the upper direction of FIG. 3A along the inclined surfaces 10*e* of the ribs 10*a* before coming into contact with the front end regulating portion 30 erected substantially perpendicularly from the discharge extension tray 10 (at the upstream side in the sheet discharge direction of the front end regulating portion 30).

Therefore, the front end portion Se of the sheet S1 will not collide against and get caught by the base area near the turning shaft 30*c* of the front end regulating portion 30. The sheet enters the discharge extension tray 10 at an angle θ2 being an acute angle (angle smaller than 90 degrees) along the regulating surface 30*a* of the front end regulating portion 30 erected substantially perpendicularly from the discharge extension tray 10 at an upper area corresponding to the height of the rib 10*a* than the turning shaft 30*c*.

When the front end portion Se of the sheet S1 nipped and conveyed by the discharge roller pair 201 slides along the regulating surface 30*a* of the front end regulating portion 30 and is discharged in the direction of arrow A of FIG. 3A, the firmness of the sheet S1 causes the front end regulating portion 30 to be pushed down toward the direction of arrow C of FIG. 3A around the turning shaft 30*c* opposing to the biasing force of the torsion coil spring 33 and turned to the second position, so that it is moved to the outer side of the sheet discharge apparatus 200.

Thereby, the sheet S1 nipped and conveyed by the discharge roller pair 201 can be prevented from being caught by the base portion of the front end regulating portion 30, and can move the front end regulating portion 30 to the outer side of the sheet discharge apparatus 200. Thereby, the sheets S1 can be prevented from being jammed or curled or even damaged on the discharge tray 20, and since the front end regulating portion 30 is turned to a second position, the user can receive sheets S1 more easily.

Furthermore, the inclined surfaces 10*e* of the ribs 10*a* are connected successively with an angle θ1 being an obtuse angle (angle greater than 90 degrees) with respect to the sheet guide surface 10*d* of the discharge extension tray 10. Thereby, it becomes possible to minimize the conveyance resistance when the front end portion Se of the sheet S1 discharged along the sheet guide surface 20*a* of the discharge tray 20 or along the sheet guide surface 10*d* of the discharge extension tray 10 contacts the inclined surfaces 10*e* of the ribs 10*a*.

When discharging sheets St having a standard length, such as an A4-sized sheet, or a sheet having a length shorter than that, the sheets St will be stacked on the discharge tray 20 without having the front end portion Se of the sheets St reach the inclined surfaces 10*e* of the ribs 10*a*, as shown in FIG. 3B. Thus, the ribs 10*a* will not influence the stacking performance or the alignment of the sheets St when stacking the sheets St having a standard length, such as A4-sized sheets, or sheets S having a length shorter than that, on the discharge tray 20.

Further, as shown in FIG. 3C, the user can draw out the discharge extension tray 10 to an appropriate position in correspondence with the long-sized sheet S1, such as the LGL size longer than the length of the sheet St of A4 size as given length.

In that state, the base point 10*f* of the change of angle between the sheet guide surface 10*d* of the discharge extension tray 10 and the inclined surfaces 10*e* of the ribs 10*a* (change of angle in which the sheet guide portion is formed) is set as follows. The base point 10*f* is positioned on the downstream side in the sheet discharge direction than the front end portion Se of the long-sized sheet S1 of LGL size or the like which is longer than the sheet St having a standard length such as A4 size discharged on the discharge extension tray 10.

Thereby, even when the user draws out the discharge extension tray 10 to an appropriate position before the long-sized sheet S1 of LGL size or the like is discharged, the sheet S1 will be discharged and stacked on the discharge tray 20 and the discharge extension tray 10 without the front end portion Se of the sheet S1 reaching the inclined surfaces 10*e* of the ribs 10*a*.

Thus, the ribs 10*a* will not affect the stacking performance or alignment of the sheets S1 when long-sized sheets S1 of LGL size or the like are discharged and stacked on the discharge tray 20 and the discharge extension tray 10. The middle and uppermost discharge trays 21 and 22, discharge extension trays 11 and 12 and front end regulating portions 31 and 32 of the sheet discharge apparatus 200 illustrated in FIG. 1 are configured similarly.

As described, according to the present embodiment, the occurrence of jamming and curling of the sheet S or damaging of the sheet S can be reduced, regardless of the set position of the discharge extension trays 10 through 12 or the size of the sheets S.

Especially, as shown in FIG. 3A, even when a sheet S1 having a longer size than a predetermined size is discharged without drawing out the discharge extension tray 10, the front end portion Se of the sheet S1 can be lifted to the upper direction of FIG. 3A along the inclined surface 10*e* of the rib 10*a* without being caught by the base portion of the front end regulating portion 30.

Moreover, as shown in FIG. 3B, if a sheet St having a size equal to or smaller than the predetermined size is discharged without drawing out the discharge extension tray 10, the front end portion Se of the sheet St will not reach the inclined surfaces 10*e* of the ribs 10*a*. Therefore, the stacking performance or alignment of the sheets St on the discharge tray 20 will not be influenced.

Second Embodiment

Next, the configuration of the sheet discharge apparatus according to a second embodiment will be described with reference to FIGS. 7A and 7B. The components having similar configurations as the first embodiment are denoted with the same reference numbers, or with the same member name even when a different reference number is assigned, and the descriptions thereof are omitted.

According to the first embodiment, as shown in FIG. 2A, substantially triangular ribs 10*a* are disposed to protrude from the discharge extension trays 10 through 12. In the present embodiment, as shown in FIGS. 7A and 7B, a sloped panel 10*b* as sheet guide portion having a width corresponding to the width of the cutout portion 20*b* of the discharge tray 20 is disposed at the center of the end portion at the downstream side in the sheet discharge direction of the discharge extension tray 10 of the stacking portion 23A. As shown in FIGS. 7A and 7B, the sloped panel 10*b* is exposed through the cutout portion 20*b* of the discharge tray 20 in a state where the discharge extension tray 10A is stored completely below the discharge tray 20.

The sloped panel 10*b* of the present embodiment is formed by cutting out a portion of the discharge extension tray 10A. The sloped panel 10*b* is bent and connected successively with an angle θ1 which is an obtuse angle (angle greater than 90 degrees) with respect to the sheet guide surface 10*d* of the discharge extension tray 10A to the upper direction of FIGS. 7A and 7B. That is, the sloped panel 10*b* is a bent portion where a portion of the discharge extension tray 10A is bent upward in the downstream direction of the sheet discharge direction.

The respective turning shafts 30*c* of the front end regulating portion 30 according to the present embodiment are supported by a wall surface portion having cut out the sloped panel 10*b* of the discharge extension tray 10. At least a portion (all, in the illustrated example) of the sloped panel 10*b* is disposed on the upstream side in the discharge direction than the turning center of the turning shaft 30*c*.

The inclined surface 10*h* of the sloped panel 10*b* as the sheet guide portion according to the present embodiment is formed with a planar shape where the angle of the discharge extension tray 10A is changed in a direction where the inclination is increased with respect to the horizontal direction than the sheet discharge direction of the discharge extension tray 10A. In other words, the inclined surface 10*b* is inclined upward in the downstream direction of the sheet discharge direction.

Thereby, similar to the first embodiment illustrated in FIG. 3A, the front end portion Se of the long-sized sheet S1 longer than a predetermined size can be discharged in a manner lifted toward the upper direction of FIGS. 7A and 7B along the inclined surface 10*h* of the sloped panel 10*b* before coming into contact with the front end regulating portion 30.

The length of a given sheet S according to the present embodiment is 297 mm, which is the longitudinal length of the A4-sized (210 mm×297 mm) sheet St. Further, in the sheet discharge direction shown by the direction of arrow A of FIG. 7B, the base point 10*f* of the change of angle from the sheet guide surface 10*d* to the inclined surface 10*h* of the discharge extension tray 10A is set as follows. That is, the base point is set to be positioned on the downstream side in the sheet discharge direction (right side of FIG. 7B) than the front end portion Se of the sheet St of A4 size as predetermined size being discharged and stacked on the discharge tray 20. FIG. 7B is in a state where the discharge extension tray 10A is not drawn out with respect to the discharge tray 20. Therefore, in a state where the discharge extension tray 10A is not extended, the sloped panel 10*b* is positioned on the downstream side in the sheet discharge direction than the front end portion Se of the predetermined sized sheet St discharged on the discharge tray 20.

Therefore, as shown in FIGS. 7A and 7B, we will consider a case where a long-sized sheet S1 of LGL size or the like is discharged without having the discharge extension tray 10A drawn out. When the sheet S1 is discharged in the sheet discharge direction shown by the direction of arrow A of FIG. 7B, the sheet is conveyed to slide along the inclined surface 10*h* of the discharge extension tray 10A before the front end portion Se reaches the front end regulating portion 30, and that the front end portion Se is lifted in the upper direction of FIG. 7B.

The behavior of the sheet S1 and the front end regulating portion 30 thereafter is similar to the first embodiment illustrated in FIG. 3A, so that the same descriptions are omitted. The middle and uppermost discharge trays 21 and 22, discharge extension trays 11 and 12 and front end regulating portions 31 and 32 of the sheet discharge apparatus 200 shown in FIG. 1 are configured similarly.

Thereby, as shown in FIGS. 7A and 7B, even when the long-sized sheet S1 of LGL size or the like is discharged without having the discharge extension tray 10A drawn out, the sheet S1 is prevented from being jammed or curled or even damaged on the discharge tray 20.

When discharging the sheet St having an A4-sized length or the sheet S having a shorter length, the front end portion Se of the sheet St is stacked or the discharge tray 20 without reaching the inclined surface 10*h* of the discharge extension tray 10A, similar to the first embodiment illustrated in FIG. 3B. Therefore, the inclined surface 10*h* of the discharge extension tray 10A will not affect the stacking performance and the alignment of the sheets St stacked on the discharge tray 20.

Furthermore, the long-sized sheet S1 of LGL size and the like is discharged after the user has drawn out the discharge extension tray 10A to the appropriate position. Also in that state, the sheets S1 are stacked on the discharge tray 20 and the discharge extension tray 10 without having the front end portion Se of the sheets S1 reach the inclined surface 10*h* of the discharge extension tray 10A, similar to the first embodiment illustrated in FIG. 3C.

Therefore, the inclined surface 10*h* of the discharge extension tray 10A will not affect the stacking performance and the alignment of the sheet S1 stacked on the discharge tray 20 and the discharge extension tray 10A. The other configurations are similar to the configuration of the first embodiment, and a similar effect can be achieved.

Third Embodiment

Next, the configuration of a sheet discharge apparatus according to a third embodiment will be described with reference to FIGS. 8A and 8B. The components having similar configurations as the respective embodiments are denoted with the same reference numbers, or with the sane member name even when a different reference number is arranged, and the descriptions thereof are omitted.

Figure 8A:
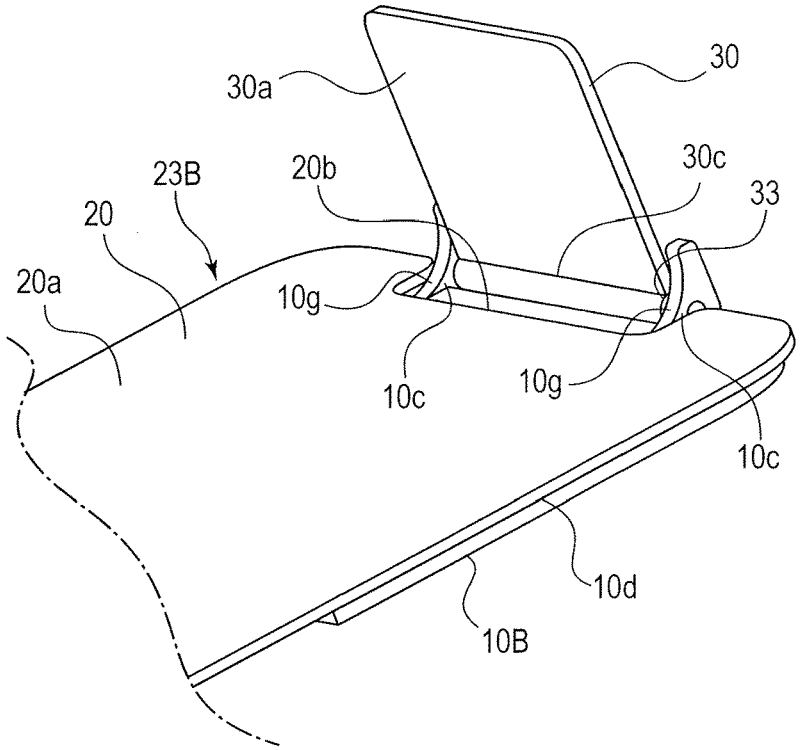
FIG. 8A is a perspective view illustrating a configuration of a sheet discharge apparatus according to a third embodiment.
Figure 8B:
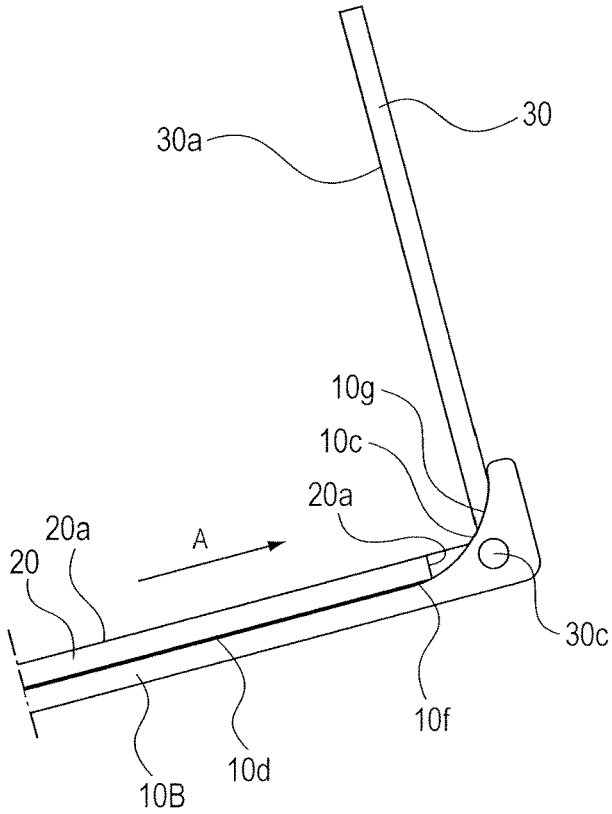
FIG. 8B is a cross-sectional view showing a configuration of the sheet discharge apparatus according to the third embodiment.

As shown in FIGS. 8A and 8B, the present embodiment has a pair of bearing portions 10*c* disposed at a position corresponding to an inner circumferential surface of the cutout portion 20*b* of the discharge tray 20 at the center of the end portion in the downstream side in the sheet discharge direction of the discharge extension tray 10B. The pair of bearing portions 10*c* as sheet guide portions have curved surfaces 10*g* as inclined surface, respectively.

The curved surfaces 10*g* are curved surfaces curved in a dented manner, formed of a curved shape disposed on the bearing portions 10*c* of the turning shaft 30*c* as the coupling portion with the front end regulating portion 30 of the discharge extension tray 10B.

Each turning shaft 30*c* disposed on the front end regulating portion 30 of the present embodiment is axially supported by the pair of bearing portions 10*c* of the discharge extension tray 10B.

As shown in FIGS. 8B and 8C, the curved surfaces 10*g* on the bearing portions 10*c* are exposed through the cutout portion 20*b* of the discharge trey 20 in the state where the discharge extension tray 10B is completely stored below the discharge tray 20. As shown in FIGS. 8A and 8B, a portion of the curved surface 10*g* is overlapped with the turning shaft 30*c* in the discharge direction. Accordingly, a portion of the pair of bearing portions 10*c* is disposed on the upstream side in the sheet discharge direction than the turning center of the turning shaft 30*c*.

As shown in FIGS. 8A and 8B, the curved surfaces 10*g* of the bearing portions 10*c* according to the present embodiment are curved with a given curvature and connected successively to the sheet guide surfaces 10*d* through 12*d* of the discharge extension tray 10.

Similar to the first embodiment shown in FIG. 3A, the front end portion Se of the sheet S1 longer than a predetermined size is discharged along the curved surfaces 10*g* on the bearing portions 10*c* and lifted upward in FIGS. 8A and 8B before coming into contact with the front end regulating portion 30.

The length of a given sheet S according to the present invention is 297 mm, which is the longitudinal length of the sheet St of A4 size (210 mm×297 mm). Further, in the sheet discharge direction shown by the direction of arrow A of FIG. 8B, the base point 10*f* of the change of angle where the curved surfaces 10*g* are started from the sheet guide surface 10*d* of the discharge extension tray 10B is set as follows. That is, the base point 10*f* is set to be positioned at a downstream side (right side of FIG. 8B) in the sheet discharge direction than the front end portion Se of the sheet St when the A4-sized sheet St as predetermined size is discharged and stacked on the discharge tray 20. FIG. 8B shows a state where the discharge extension tray 10B is not drawn out from the discharge tray 20. Therefore the bearing portions 10*c* are positioned on the downstream side in the sheet discharge direction than the front end portion Se of the predetermined sized sheet St discharged on the discharge tray 20 in a state where the discharge extension tray 10B is not extended.

Therefore, as shown in FIGS. 8A and 8B, we will consider a case where the long-sized sheet S1 such as LGL size is discharged without having the discharge extension tray 10B drawn out. When the sheet S1 is discharged in the sheet discharge direction shown by the direction of arrow A of FIG. 8B, the sheet slides along the curved surfaces 10*g* on the bearing portions 10*c* of the discharge extension tray 10B before the front end portion Se reaches the front end regulating portion 30, so that the front end portion Se is lifted in the upper direction of FIG. 8B.

The behavior of the sheet S1 and the front end regulating portion 30 thereafter is equivalent to the aforementioned the first embodiment illustrated in FIG. 3A, so that the same descriptions will be omitted. Now, the middle and uppermost discharge trays 21 and 22, discharge extension trays 11 and 12 and front end regulating portions 31 and 32 of the sheet discharge apparatus 200 shown in FIG. 1 are configured similarly.

Thereby, as shown in FIGS. 8A and 8B, even when the long-sized sheet S1 of LGL size and the like is discharged without having the discharge extension tray 10B drawn out, the jamming and curling of the sheet S1 or even damaging of the sheet S1 on the discharge tray 20 can be prevented.

Furthermore, when the front end portion Se of the sheet S1 initially contacts the curved surfaces 10*g* on the bearing portions 10*c*, the abutting angle is gentle, so that the front end portion Se of the sheet S1 will not be easily damaged.

A sheet St having a length equal to an A4 size sheet or a sheet S having a shorter length can be discharged. At that time, similar to the first embodiment shown in FIG. 3B, the sheet is stacked without having the front end portion Se of the sheet St reach the curved surfaces 10*g* on the bearing portions 10*c* of the discharge extension tray 10B. Therefore, the curved surfaces 10*g* on the bearing portions 10*c* of the discharge extension tray 10B will not affect the stacking performance and alignment of the sheet St.

Further, the long-sized sheet S1 of LGL size and the like can be discharged after the user draws out the discharge extension tray 10B to an appropriate position. Also in that case, similar to the aforementioned the first embodiment illustrated in FIG. 3C, the sheet S1 will be stacked on the discharge tray 20 and the discharge extension tray 10 without having the front end portion Se of the sheet S1 reach the curved surfaces 10*g* on the bearing portions 10*c* of the discharge extension tray 10B.

Therefore, the curved surfaces 10*g* on the bearing portions 10*c* of the discharge extension tray 10B will not affect the stacking performance or the alignment of the sheet S1 stacked on the discharge tray 20 and the discharge extension tray 10B. The other configurations are composed similarly as the first embodiment, and similar effects can be achieved.

In the respective embodiments described above, one example of the given length of a sheet S is 297 mm, which is the longitudinal length of an A4-sized sheet (210 mm×297 mm). However, the length can be set to correspond to other various sheet S sizes. Actually, the embodiments can be applied to various sheet S sizes by arbitrarily changing the initial position of the discharge extension tray and the draw-out length thereof.

Ribs 10*a* or sloped panel 10*b* having inclined surfaces 10*e* and 10*h*, or bearing portions 10*c* having curved surfaces 10*g*, are provided on the downstream side in the sheet discharge direction of the discharge extension tray. Then, a configuration is adopted where the front end portion Se of the sheet S1 longer than the predetermined size is lifted upward without being in contact with the area near the turning center of the front end regulating portion 30 of the sheet S1.

Thereby, the front end regulating portion 30 of the sheet S1 can be turned to the outer side of the sheet discharge apparatus 200 when the sheet S1 is discharged. Further, the occurrence of jamming and curling of the sheet S1 or the damaging of the sheet S1 caused by the user erroneously manipulating the discharge extension trays 10, 10A and 10B can be reduced.

While the present invention has been described with reference to exemplary embodiments, it is to be understood that the invention is not limited to the disclosed exemplary embodiments. The scope of the following claims is to be accorded the broadest interpretation so as to encompass ail such modifications and equivalent structures and functions.

This application claims the benefit of Japanese Patent Application No. 2014-239412, filed Nov. 27, 2014 which is hereby incorporated by reference herein in its entirety.

What is claimed is:

1. An image forming apparatus for forming an image on a sheet, the image forming apparatus comprising:

a main assembly including an image forming portion configured to form the image on the sheet; and a sheet discharge unit disposed above the main assembly, the sheet discharge unit including:

a plurality of discharge portions including a first discharge portion and a second discharge portion disposed above the first discharge portion, configured to discharge the sheet on which the image had been formed by the image forming portion to an outside of the image forming apparatus; and a plurality of trays including a first tray on which the sheet discharged by the first discharge portion is to be stacked and a second tray on which the sheet discharged by the second discharge portion is to be stacked, the second tray being disposed above the first tray, wherein each of the first and second trays includes a protruding portion which protrudes from a surface thereof on which the sheet is to be stacked and which is disposed in a downstream end thereof in a discharge direction of the sheet, wherein when viewed in a width direction of the sheet perpendicular to the discharge direction of the sheet, the protruding portion includes an inclined surface which is inclined upward in the discharge direction of the sheet and which is inclined with respect to a vertical direction, and wherein the main assembly includes a cartridge in which the image forming portion is provided, and wherein the cartridge is arranged between the second discharge portion and the protruding portion of the second tray in the discharge direction of the sheet when the image forming portion forms the image on the sheet.

2. The image forming apparatus according to claim 1, wherein each of the first and second trays includes a cutout provided in a center region, in the width direction of the sheet, of the downstream end of each of the first and second trays.

3. The image forming apparatus according to claim 2, wherein when viewed in the width direction of the sheet, the protruding portion is provided so as to overlap with the cutout.

4. The image forming apparatus according to claim 1, wherein the protruding portion is provided in an end portion, in the width direction of the sheet, of the downstream end of each of the first and second trays.

5. The image forming apparatus according to claim 1, wherein the main assembly includes a third tray, disposed below the first tray, on which the sheet on which the image had been formed is stacked.

6. An image forming apparatus for forming an image on a sheet, the image forming apparatus comprising:

a main assembly including an image forming portion configured to form the image on the sheet; and a sheet discharge unit disposed above the main assembly, the sheet discharge unit including:

a plurality of discharge portions including a first discharge portion and a second discharge portion disposed above the first discharge portion, configured to discharge the sheet on which the image had been formed by the image forming portion to an outside of the image forming apparatus; and a plurality of trays including a first tray on which the sheet discharged by the first discharge portion is to be stacked and a second tray on which the sheet discharged by the second discharge portion is to be stacked, the second tray being disposed above the first tray, wherein each of the first and second trays includes a protruding portion which protrudes from a surface thereof on which the sheet is to be stacked and which is disposed in a downstream end thereof in a discharge direction of the sheet, wherein when viewed in a width direction of the sheet perpendicular to the discharge direction of the sheet, the protruding portion includes an inclined surface which is inclined upward in the discharge direction of the sheet and which is inclined with respect to a vertical direction, and wherein the main assembly includes a laser scanner above the image forming portion, and wherein the laser scanner is arranged between the second discharge portion and the protruding portion of the second tray in the discharge direction of the sheet.

* * * * *